US007367893B2

(12) United States Patent
Vrana et al.

(10) Patent No.: US 7,367,893 B2
(45) Date of Patent: May 6, 2008

(54) FASTENER MANUFACTURING APPARATUS AND METHOD

(75) Inventors: John J Vrana, Rochester Hills, MI (US); Harold A Ladouceur, Livonia, MI (US); Richard P Ward, Canton, MI (US); Jorge Gonzales, Canton, MI (US)

(73) Assignee: Whitesell International Corporation, Taylor, MI (US)

( * ) Notice: Subject to any disclaimer, the term of this patent is extended or adjusted under 35 U.S.C. 154(b) by 181 days.

(21) Appl. No.: 11/122,629

(22) Filed: May 5, 2005

(65) Prior Publication Data

US 2006/0252561 A1 Nov. 9, 2006

(51) Int. Cl.
*B21D 53/24* (2006.01)

(52) U.S. Cl. ..... 470/25; 470/26; 470/91; 470/95; 470/96; 470/109

(58) Field of Classification Search ..... 470/25, 470/26, 47, 91, 95, 96, 109, 165, 166, 167; 72/329, 330, 331, 336, 337, 404
See application file for complete search history.

(56) References Cited

U.S. PATENT DOCUMENTS 1,832,167 A * 11/1931 Wilcox ..... 470/25
1,957,952 A * 5/1934 Gibney ..... 470/25
2,022,076 A * 11/1935 Costin et al. ..... 470/25
3,711,931 A 1/1973 Ladouceur et al.
3,748,674 A * 7/1973 Powell et al. ..... 470/18
3,775,791 A 12/1973 Grube
3,845,860 A * 11/1974 Ladouceur et al. ..... 206/338
4,306,654 A 12/1981 Grube
4,315,688 A 2/1982 Pryor
4,679,690 A 7/1987 Steward et al.
4,971,499 A * 11/1990 Ladouceur ..... 411/179
5,016,461 A 5/1991 Walker et al.
5,348,429 A 9/1994 Pfister
5,383,021 A * 1/1995 Hanna ..... 356/634
2005/0013679 A1* 1/2005 Ladoucer et al. ..... 411/180

OTHER PUBLICATIONS

PCT/US05/15680 International Search Report dated Oct. 24, 2005.

* cited by examiner

*Primary Examiner*—Ed Tolan
(74) *Attorney, Agent, or Firm*—Howard & Howard Attorneys, P.C.

(57) ABSTRACT

An assembly line for continuously manufacturing fasteners from a rod with a groove for receiving a wire for retaining the fasteners in a strip includes a receiver for receiving the rod. A die press is arranged to receive the rod from the receiver and includes a piercing member for piercing an aperture in each fastener and a cutting member for cutting each fastener from the rod. A tapping member provides ribs to an inner wall of the aperture formed in the fastener by the piercing member. An inspector inspects the internal rib formed into the inner wall of the aperture disposed in the fastener verifying exactness of the aperture and the rib. A wire inserter inserts the wire into the groove forming a strip of connected fasteners. The inserter receives the fasteners sequentially from the inspector after verification of the exactness of the aperture disposed in each fastener.

14 Claims, 17 Drawing Sheets

122
12
32
134
12

FASTENER MANUFACTURING APPARATUS AND METHOD

FIELD OF THE INVENTION

The present invention is generally toward an approved method and apparatus of manufacturing fasteners. More specifically, the present invention is rated toward a method and apparatus of manufacturing fasteners in a continuous manner providing a strip of fasteners, which may be rolled into a coil for use at an installation site.

BACKGROUND OF THE INVENTION

Various methods of manufacturing fasteners, such as, for example, pierce nuts and the like have been used in the past and have provided satisfactory results enabling production of these types of fasteners in high volumes. End users of these pierce nuts have preferred using a continuous strip of pierce nuts connected side to side with a wire such as is disclosed in U.S. Pat. No. 3,845,860, for Fastener Strip.

The installation of the pierce nuts is greatly simplified when provided to an end user in a continuous strip wound in a coil, which eliminates the need for expensive bowl mixers and alignment devices used to align these fasteners prior to production installation into a panel. A common process for providing coils of nuts attached in a strip, such as described above, includes a combination of batch and inline process which is presently utilized.

For example, a coil of steel rod is provided to a nut manufacturing facility, and is preferably, formed to provide a cross-sectional geometric shape necessary to pierce, and/or clinch, sheet metal, and to provide a groove to receive the wire in a manner set forth above. This rod is processed through a die that both cuts individual pierce nuts and pierces an aperture through the rod forming an inner annular surface in each individual fastener. A tapping machine is positioned subsequent to the die press to provide a helical rib around the inner annular wall of the pierced aperture of each pierce fastener. These fasteners are subsequently placed into a bulk bowl feeder that aligns a plurality of the fasteners in an orientation necessary for continued processing. Various problems are associated with the above-mentioned process. For example, during the cutting stage of the die press, various grooves, and more specifically, the groove designated to receive the attachment wire is known to be deformed making it difficult to insert the wire into the wire groove in a uniform manner. Furthermore, defects associated with location and dimension of the nut apertures and vehicle groove have not yet been identified.

Once the nuts have been oriented in a uniform fashion, the nuts are transferred via a track to a wire insertion and knurling operation to attach the nuts in a continuous strip. A second press or an equivalent roller inserts the wire into the aligned wire groove of each nut and a knurling machine deforms the nut over the wire for retaining the wire in the aligned groove thereby forming the continuous strip of fasteners. Subsequently, the fasteners are rolled in a coil for shipment and for use at a production facility that installs pierce fasteners as is known to those of skill in the art.

A further problem associated with the prior art method is realized when an error occurs during the tapping or piercing process resulting in the defective formation of the aperture or helical rib disposed upon the inner surface of the aperture. Once the fasteners have been attached in a strip, it is impossible to replace a defective fastener without breaking the continuous strip resulting in a partial coil of fasteners that is undesirable to the end user. Therefore, a nearly full coil of fasteners is frequently viewed by the end user as being undesirable when a single defective fastener is discovered after the fasteners have been attached in a continuous strip. Furthermore, the smaller strip of fasteners that are separated from the nearly full coil of fasteners is generally scrapped.

A still further problem exists with the present state of the art relating back processing that reduces the throughput of fasteners through the manufacturing process. It is known to those of skill in the art that orienting nuts in a bowl feeder is a bottleneck in the manufacturing process that reduces the rate at which fasteners are manufactured resulting in a more expensive fastener. It would be desirable to eliminate the bowl feeder from the manufacturing process. Furthermore, it would be desirable to provide a continuous manufacturing process that solves the problems associated with the prior art method of manufacturing by eliminating defective nuts found in a continuous strip, eliminate the batch process of manufacturing, and providing a consistent, continuous groove formed by adjacent nuts in a strip.

SUMMARY OF THE INVENTION

The present invention provides an assembly for continuously manufacturing fasteners from a rod defining a continuous groove by receiving a wire to retain the resultant fasteners in a continuous strip. A receiver receives the rod and directs the rod into a die press that is arranged to receive the rod from the receiver. The die press includes a piercing member for piercing an aperture of each resultant fastener and a cutting member for cutting each of these fasteners from the rod received by the die press. A tapping member taps the aperture defined by each fastener providing a helical rib to an inner wall that defines the aperture. An inspection station inspects the aperture and the helical rib formed in the inner wall of the aperture to verify the exactness of the aperture and the helical rib. A wire insertion device inserts the wire into the groove of each fastener forming a continuous strip of fasteners. The insertion device receives the fasteners from the inspection station after the exactness of the aperture and the helical rib of each fastener has been verified. The inspection station is located prior to mating each individual fastener into a continuous fastener strip with the wire. This provides a solution to the manufacturing problem set forth above which resulting in incomplete strips of fasteners that are typically rejected by the end user. Furthermore, improvements associated with the inspection station, which heretofore have not been utilized, provides the use of two inspectors enabling the inspection of both major and minor diameters of the helical rib disposed on the inner wall of the aperture and the centrality of the aperture itself. Prior art inspection stations merely determine the existence of an aperture in an individual fastener and are not capable of determining the quality of the helical rib disposed within the aperture.

Pilot lines used to determine the effectiveness of, more specifically, the inspection station set forth above, have reduced the number of defective fasteners affixed to the continuous strip to nearly zero per thousand fasteners from upward of dozen per thousand fasteners.

A still further improvement over the prior art wire installation assemblies makes use of a re-groover to reform the continuous groove formed by adjacent nuts into which a carrier wire is inserted. In the cutting station of the die press, the continuous groove formed in the rod is known to be deformed by the die press resulting in an inconsistent installation of the wire by the wire insertion device. This inconsistent installation of the wire along the continuous groove formed by adjacent fasteners is known to result in broken wire at the end user causing a manufacturing defect in the tooling used to affix the fasteners to a product. By reforming the groove, a consistent, continuous groove is formed between adjacent fasteners enabling the uniform installation of the carrier wire further enabling a uniform knurling affixation of the wire eliminating defects associated with the inconsistent affixation set forth above.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
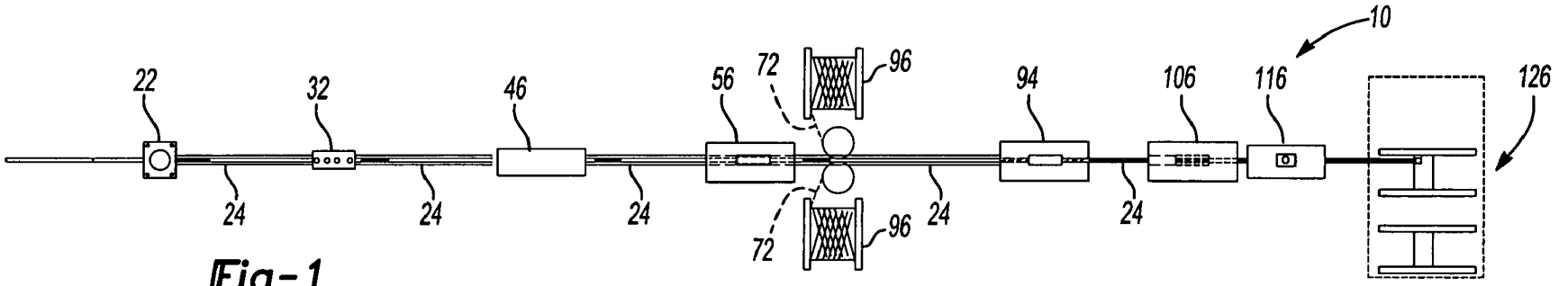
FIG. 1 shows a top view of a schematic of the present inventive assembly.
Figure 2:
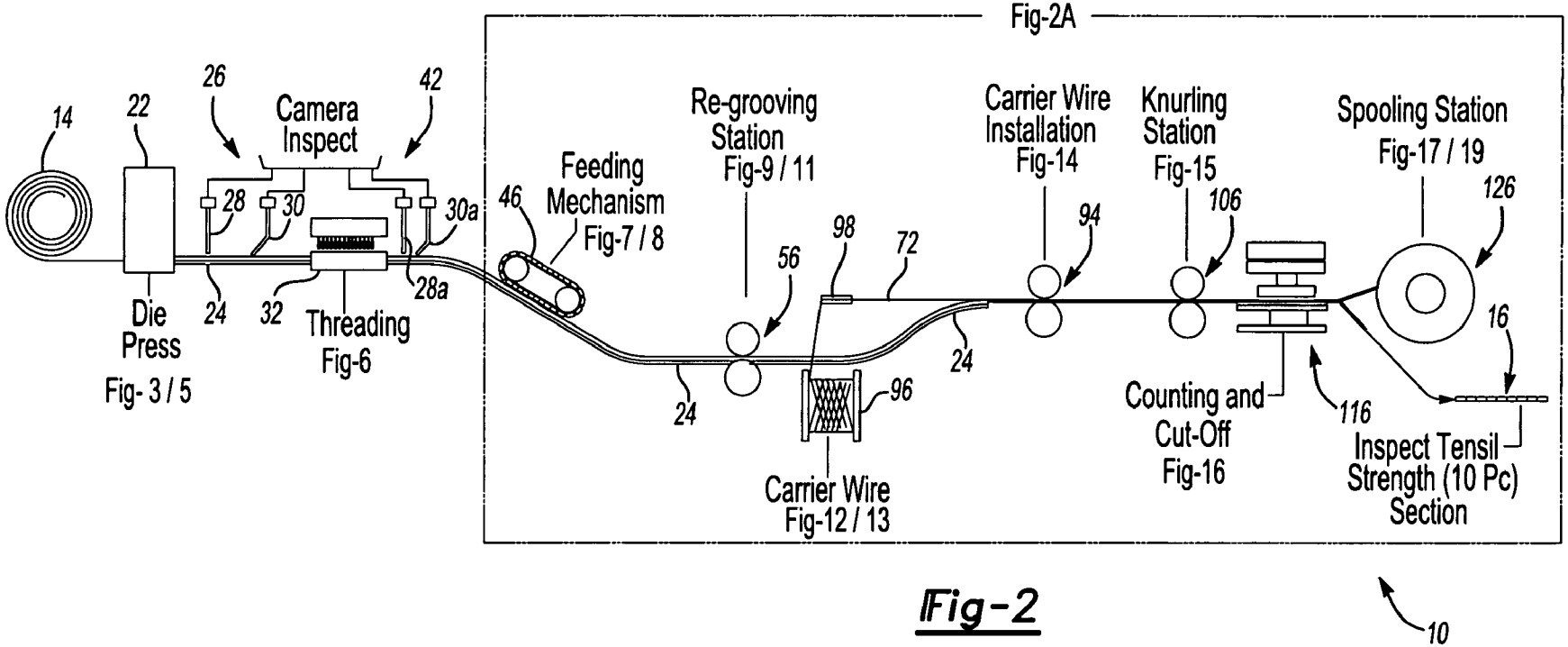
FIG. 2 shows a side view of a schematic of the present inventive assembly.

Referring to FIGS. 1 and 2, one preferred embodiment of the inventive assembly for manufacturing fasteners is generally shown at 10. The assembly 10 provides a method of continuously manufacturing, for example, pierce nuts 12 (FIG. 3) from a coiled rod 14 resulting in a continuous strip 16 of fasteners (fastener strip, see FIGS. 17 and 18) for use in a production facility where pierce nuts 12 are mechanically locked to sheet metal at a high rate of speed.

Figure 8:
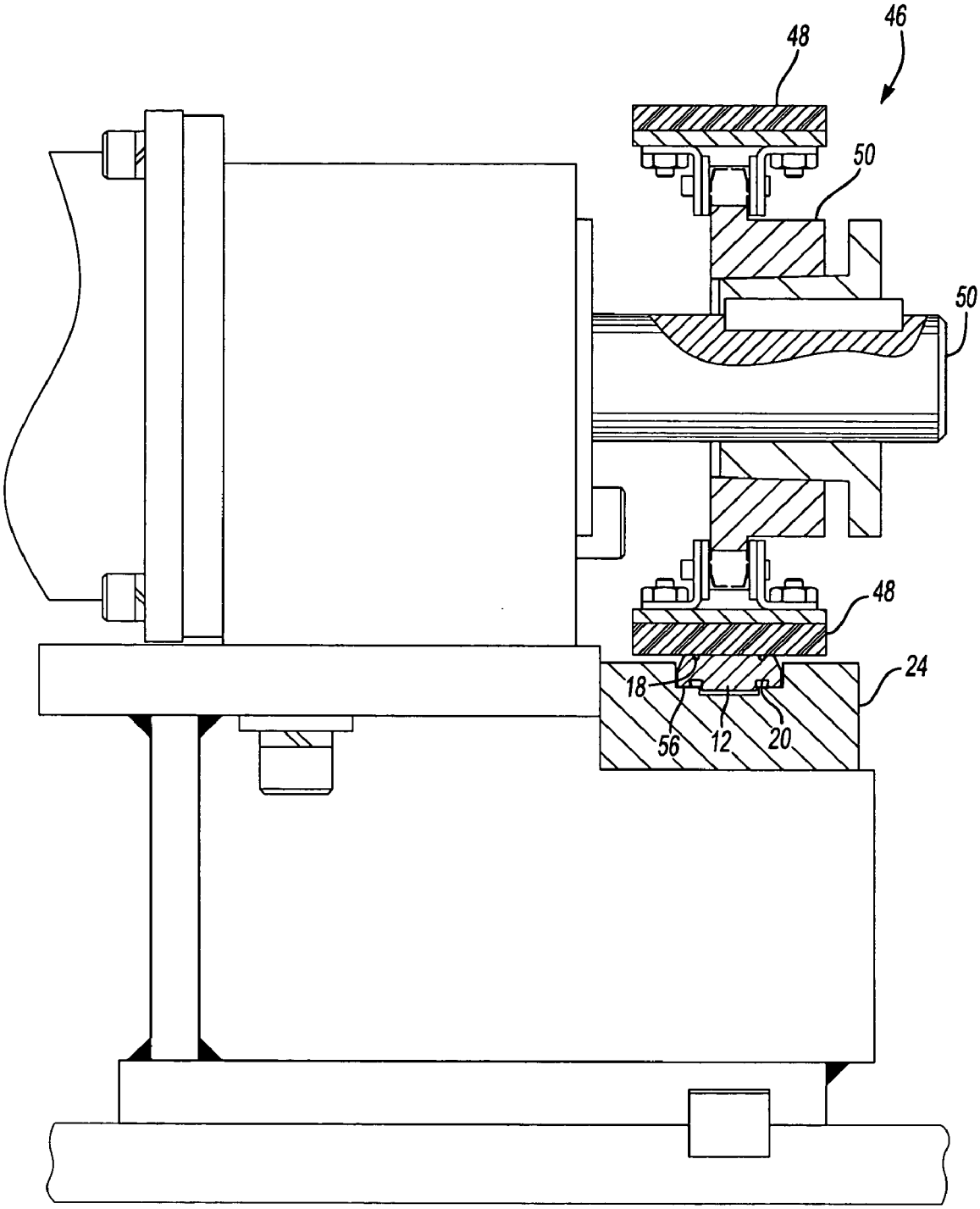
FIG. 8 shows rear sectional view of the transfer.

Preferably, the rod 14 has been preformed with at least one, and more preferably two wire grooves 18 and at least one, and preferably opposing re-entrant grooves 20 as is best represented by the cross-sectional view of the pierce nut 12 shown in FIG. 8, the purpose of which will be more evident and explained further below. In the preferred embodiment, a die press 22 receives the rod 14 to pierce and cut individual pierce nuts 12. The individual pierce nuts 12 are transferred from the die press 22 through a continuous track 24 in an abutting relationship so that the wire groove 18 of each individual pierce nut 12 defines a "continuous" wire groove between adjacent pierce nuts 12, the purpose of which will be more evident further below. The continuous track 24 transfers the pierce nuts 12 between the various manufacturing stations of the assembly 10 maintaining the pierce nuts 12 in a desired orientation to facilitate further processing through the assembly 10.

A first inspection station 26 is located immediately subsequent the die press 22 and includes a first light inspector 28 oriented in a generally vertical direction to verify the piercing operation as performed successfully. Optionally, a second light inspector 30 is also positioned immediately subsequent the die press 22 in the first inspection station 26 in an angular relationship to the first light inspector 28, the purpose of which will be explained in alternative embodiments set forth below.

Figures 6, 6A, 7:
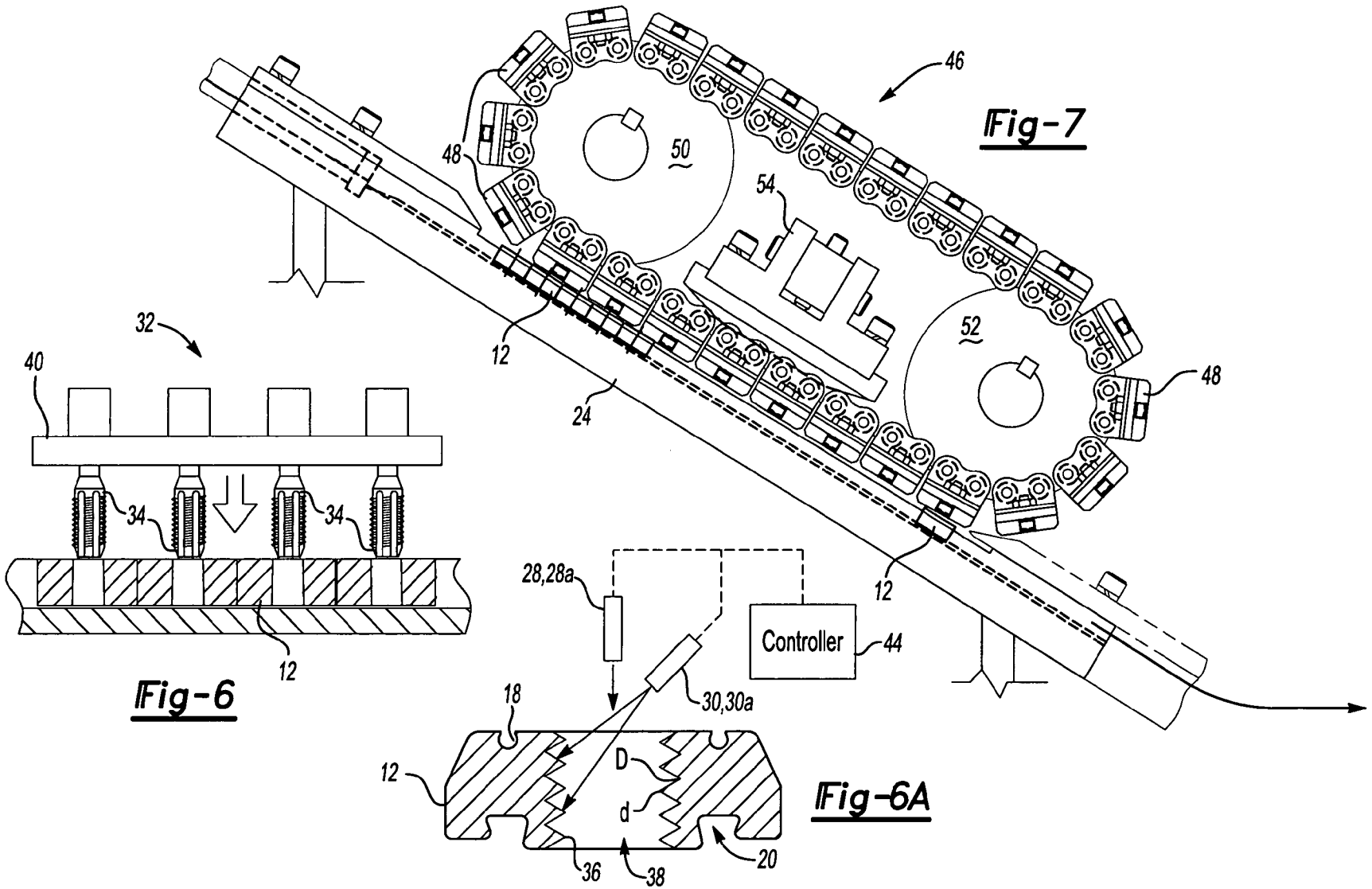
FIG. 6 shows a side view of the tapper of present invention.
FIG. 6A shows an inspector used in the present inventive assembly.
FIG. 7 shows a side view of the transfer of the present invention.

A tapping member 32, also seen in FIG. 6, is located immediately subsequent to the first inspection station 26 and includes, preferably, a plurality of tappers 34 used to form an internal or helical rib 36 upon an inner wall of an aperture 38 defined by each of the pierce nut 12 (FIG. 6A). It should be understood that alternative pierce nuts 12, such as, for example, self tapping pierce nuts that have alternative ribbing are also contemplated by the inventors. Each tapper 34 is mounted upon an actuator 40 that moves in a vertical direction while rotating each tapper 34 to form the helical rib 36 or thread on the inner wall of the aperture 38. While the Figures represent the tappers 34 operating above the pierce nuts 12, it should be understood that the tappers 34 may also operate below the pierce nuts 12 so that either sides of each pierce nut 12 may be tapped. Each tapper 34 floats in a horizontal direction independent from the other tappers 34 maintaining a constant vertical axis so that the aperture 38 of each pierce nut 12 guides the tapper's 34 movement in the vertical direction to consistently form the helical rib 36 in each of the pierce nuts 12. The floating tapper 34 eliminates defects to the helical rib 36 that would otherwise be caused by an off center aperture 36 or a slight gap disposed between adjacent pierce nuts 12 in the continuous track 24. The number of tappers 34 disposed in the tapping member 32 are correlated with the rate of production of pierce nuts 12 set forth by the die press 22. As is known to those of skill in the art, tapping is the slowest operation of the pierce nut manufacturing process and requires a plurality of tappers 34 to keep pace with the single die press 22.

A second inspection station 42 is located immediately subsequent the tapping member 32 and includes a first light inspector 28*a* and a second inspector 30*a* similar to that disposed in the first inspection station 26. Referring again to FIG. 6A, as set forth previously, the first light inspector 28*a* is oriented in a generally vertical direction and inspects the centrality and existence of the aperture. The second light inspector 30*a* is oriented in a generally angular relationship to the first light inspector 28*a* so that visible access is provided to both the major D and minor d diameters of the helical rib 36. Therefore, the quality of the helical rib 36 is also inspected. In a first embodiment, the first light inspector 28, 28A and the second light inspector 30, 30*a* are cameras provided by Keyance, Model No. CV-020, and interfaces with a controller 44 for interpreting the images generated by the first light inspector 28, 28*a* and the second light inspector 30, 30*a* to verify the quality of both the aperture 38 and the helical rib 36. In this embodiment, the controller 44 is a CV-2100P that is cooperable with the camera model as set forth above. It should be understood by those of skill in the art that infrared sensors and the like may also be used to detect the quality of both the aperture 38 and the helical rib 36 and are contemplated for use in an alternate embodiment.

It is necessary to advance the individual pierce nuts 12 along the continuous track 24 for further processing. Preferably, the method of advancement should reduce the probability of adversely contacting the pierce nut 12, and more specifically, the helical rib 36 disposed upon each pierce nut 12, which could result in damaging the pierce nut 12. Therefore, a feeder 46 as best seen in FIGS. 2 and 7 makes use of contact pads 48 preferably formed from a polymer selected to achieve frictional engagement with the fasteners 12. A plurality of contact pads 48 form a continuous loop encircling a driving sprocket 50 and a dummy sprocket 52 much like a cat track. The driving sprocket 50 and the dummy sprocket 52 are spaced so that a plurality of contact pads 48 contact the upper surface of a plurality of adjacent pierce nuts 12 advancing along the continuous track 24. A compressor 54 provides downward force upon the contact pads 48 to ensure sufficient frictional contact between the contact pads 48 and the pierce nuts 12 to advance the pierce nuts 12 along the continuous track 24. One advantage of the feeder 46 set forth above is the gaps disposed between adjacent pierce nuts 12 are necessarily eliminated providing processing benefits in subsequent operation stations disposed in the assembly 10. Supporting each pierce nut 12 in this manner reduces the potential for distorting the pierce nuts 12 due to the pressure exerted upon the pierce nuts 12 by the feeder 46, and more specifically the contact pads 48 when force is exerted downwardly by the compressor 54.

As set forth in the background section of the present application, one known defect associated with cutting individual pierce nuts 12 from a preformed rod 14 is the distortion of at least the wire groove 18 disposed in each of the individual fasteners, and which a continuous wire groove 18 is formed by adjacent fasteners. To form a uniform wire groove 18 along adjacent fasteners, a regroover 56 is located in the assembly 10 subsequent the feeder 46. Preferably, beneath the feeder 46, each pierce nut 12 is supported upon its panel support surface 56 by the continuous track 24 as is best shown in FIG. 8.

Figure 2A:
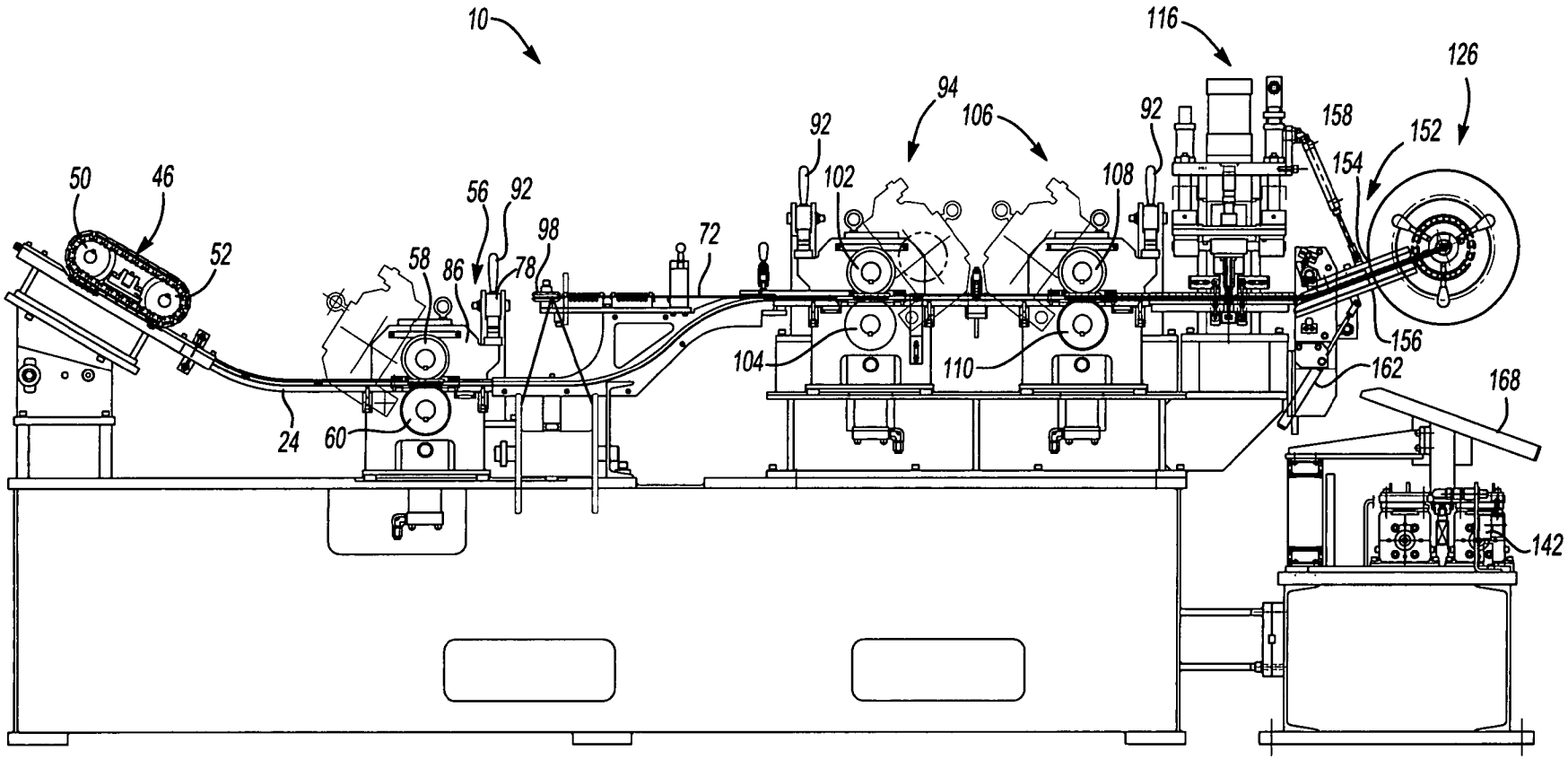
FIG. 2A shows an expanded side view of a partial schematic beginning with the transfer.
Figure 9:
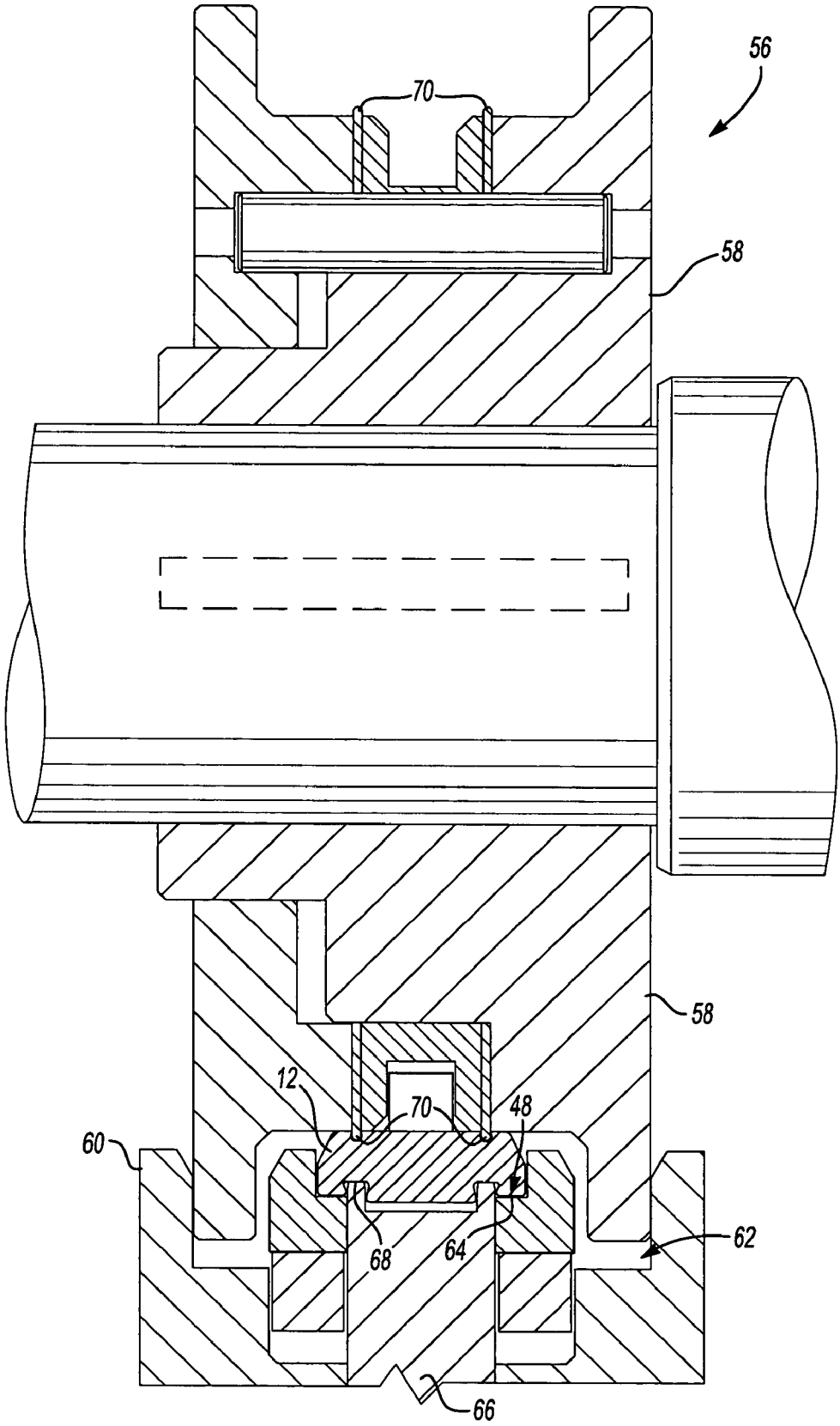
FIG. 9 shows a front partial sectional view of the inventive regroover.

Referring now to FIGS. 2A and 9, which best represent the regroover 56, an upper regroover roller 58 and a lower regroover roller 60 contact opposing sides of the pierce nuts 12 advancing along the continuous track 24 as driven by the feeder 46. The upper regroover roller 58 provides downward pressure upon each of the pierce nuts 12 while the lower regroover roller 60 supports the pierce nuts 12 from the bottom. As best shown in FIG. 9, the upper regroover roller 58 includes a diameter that is less than an opening 62 defined by the lower regroover roller so that the upper regroover roller 58 is received by the lower regroover roller 60 for preventing either of the regroover rollers 58, 60 from moving in a generally horizontal direction resulting in defective fasteners. The lower regroover roller 60 includes contact pads support 64 to support the contact pads 48 of each of the pierce nuts 12 during the regrooving operation. A secondary support 66 includes support rims 68 that are received by the re-entrant groove 20 of each of the fasteners providing additional support to the pierce nuts 12 for reducing the potential of distortion during the regrooving operation. The upper regroover roller 58 includes opposing regroover rims 70 that are received by each of the wire grooves 18 for reforming the wire grooves 18. The reformation of the wire groove 18 forms a uniform continuous wire groove 18 defined by adjacent pierce nuts 12 eliminating distortions caused by the die press 22 when cutting the individual pierce nuts 12 from the rod 14. The regroover rims 70 contain the annular shape of the wire groove 18 as originally formed in the rod 14, which is adapted to receive carrier wire 72 (FIGS. 1, 2). In an alternative embodiment, each regroover rim 70 is scored or chafed to provide an abrasive surface in the base of the wire groove 18 to prevent the carrier wire 72 from slipping after installation.

Figure 10:
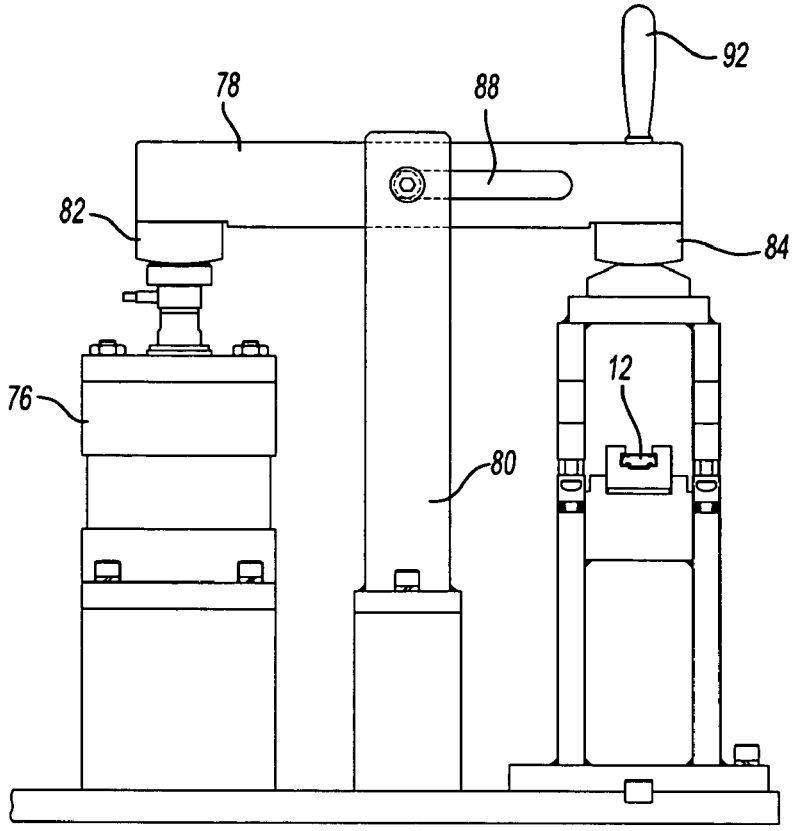
FIG. 10 shows a front view of the force producer in a closed position.
Figure 11:
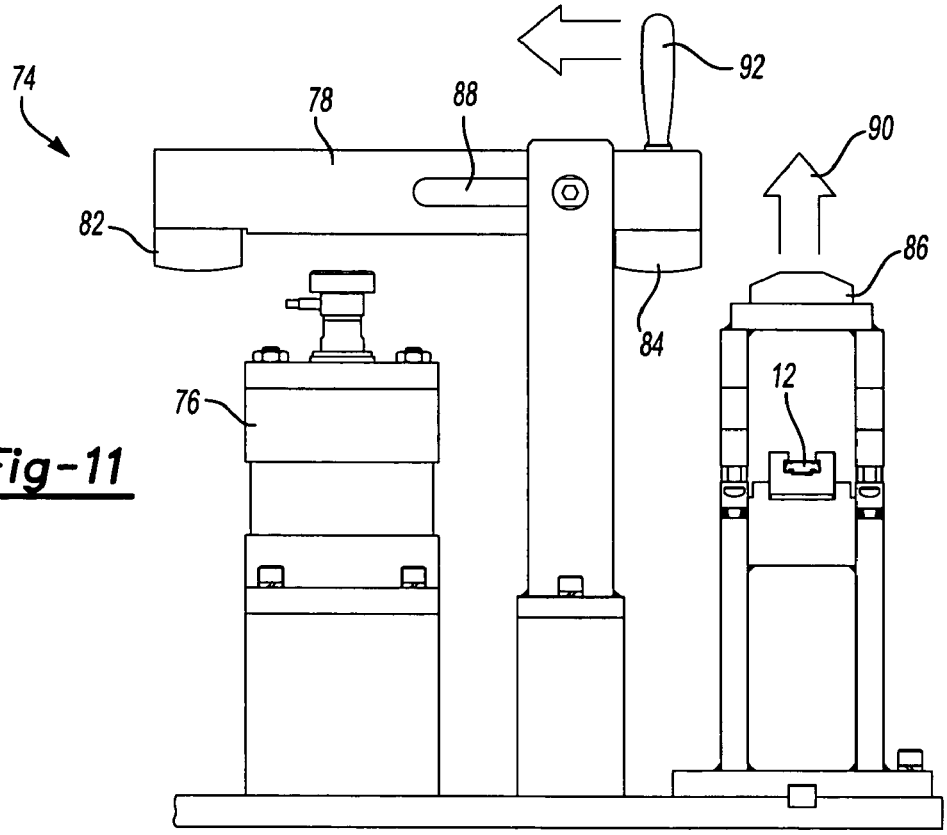
FIG. 11 shows a front view of the force producer in an open position.

It is desirable to maintain a constant downward pressure on the upper regroover roller 58 to form the continuous wire groove 18 across adjacent pierce nuts 12 with a uniform disposition. FIGS. 10 and 11 show a force producer 74 preferably operated by an air cylinder 76 or other fluid actuation device. A lever arm 78 is pivotally supported by fulcrum 80. The lever arm 78 includes a first contact 82 that is cooperable with the air cylinder 76 and a second contact 84 that is cooperable with the upper regroover roller 58. The air cylinder 76 provides an upward force to the first contact 82, which by virtue of the lever arm 78 transfers downward force to the second contact 84 providing the necessary downward force to the upper regroover roller 58 to reform the wire groove 18. An upper roller support 86 receives the downward force from the second contact 84 while pivotally supporting the upper regroover roller 58. During a maintenance operation, the roller support 86 is necessarily lifted from the continuous track 24 to provide access to the pierce nuts 12 disposed beneath the upper regroover roller 58. As such, a slot 88 is disposed in the lever arm 78 allowing the lever arm 78 to disengage the air cylinder 76 and the roller support 86 as is best represented in FIG. 11. This allows the roller support 86 to be pivoted upward in direction of arrow 90 and shown in phantom in FIG. 2A providing access to the pierce nuts disposed beneath the upper regroover roller 58. A grip 92 is disposed upon the lever arm 78 to provide leverage to disengage the lever arm 78. The novel force producer 74 set forth above provides the benefit of leveraged force to the upper regroover roller 58 and ease of maintenance without having to disassemble the regroover 56.

Figure 12:
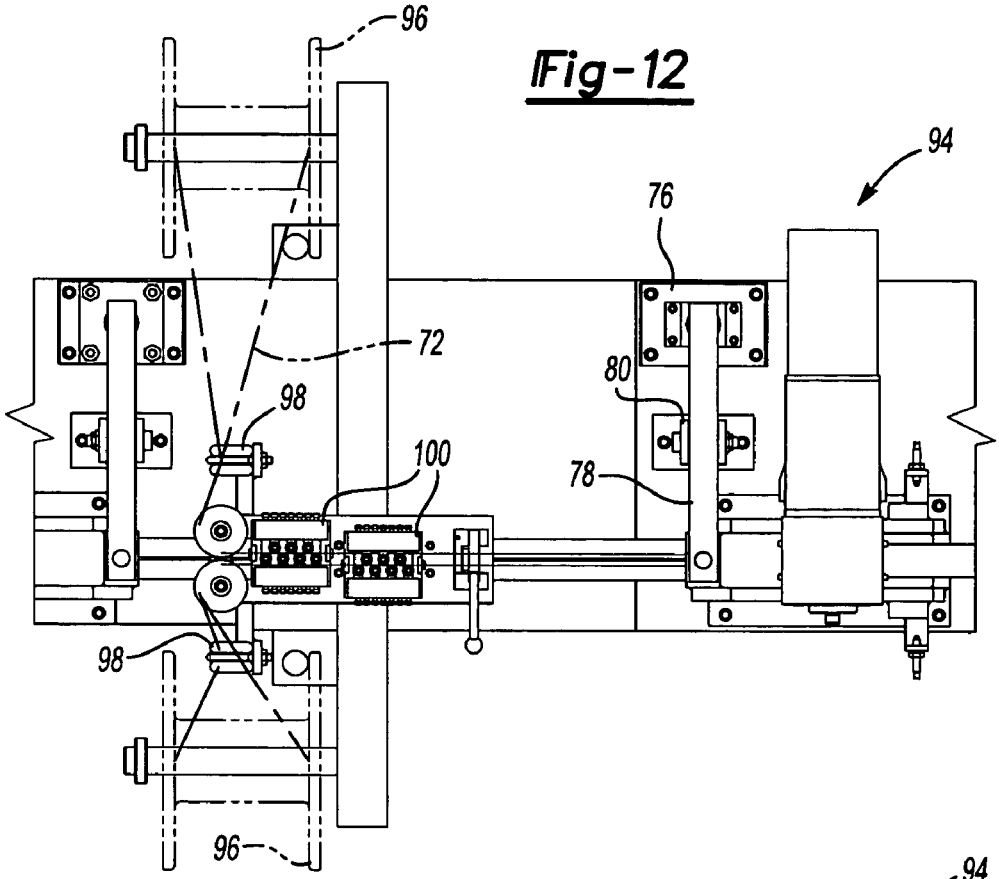
FIG. 12 shows a top view of the inventive wire inserter.
Figure 13:
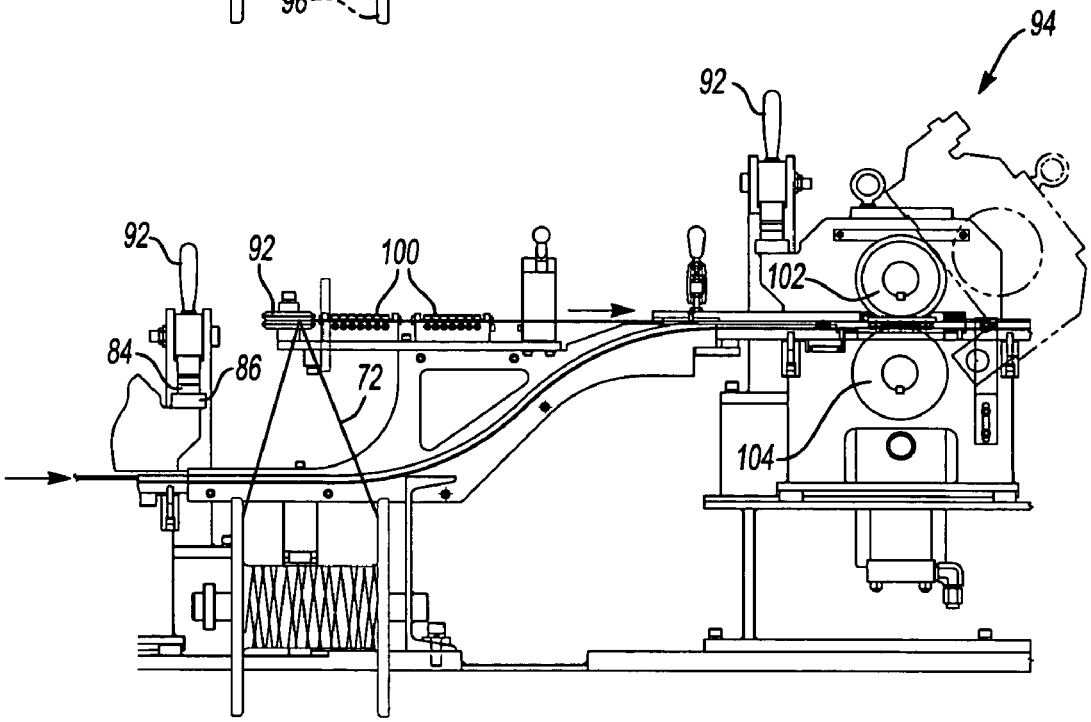
FIG. 13 is a side view of the inventive wire inserter.

A wire inserter 94 is located subsequent to the regroover 56 for inserting the carrier wire 72 into the now uniform, continuous groove 18 defined by adjacent pierce nuts 12. To reduce the number of bends in the carrier wire 72 that is common with prior art wire inserters, the carrier wire 72 is disposed upon opposing wire spools 96 located on opposite sides of the continuous track 24. As best seen in FIG. 12, a single wire redirector 98 orients the carrier wire 72 to be received by the wire groove 18 with merely a single redirection of the carrier wire 72. As best seen in FIGS. 2, 2A, and 13, the pierce nuts 12 are initially disposed below the carrier wire 72 and subsequently are driven in an upward direction on the continuous track 24 by the regroover 56 to meet a plane set by the carrier wire 72 after initial redirection so that the carrier wire 72 is not redirected a second time. This reduces the potential for defects in the carrier wire 72 resulting from over manipulation. As seen in FIGS. 12 and 13, opposing wire guides 100 verify correct orientation of each of the carrier wires 72 to be received by the pierce nuts 12 that are being lifted by the continuous track 24 to mate the wire groove 18 with the carrier wire 72.

Figure 14:
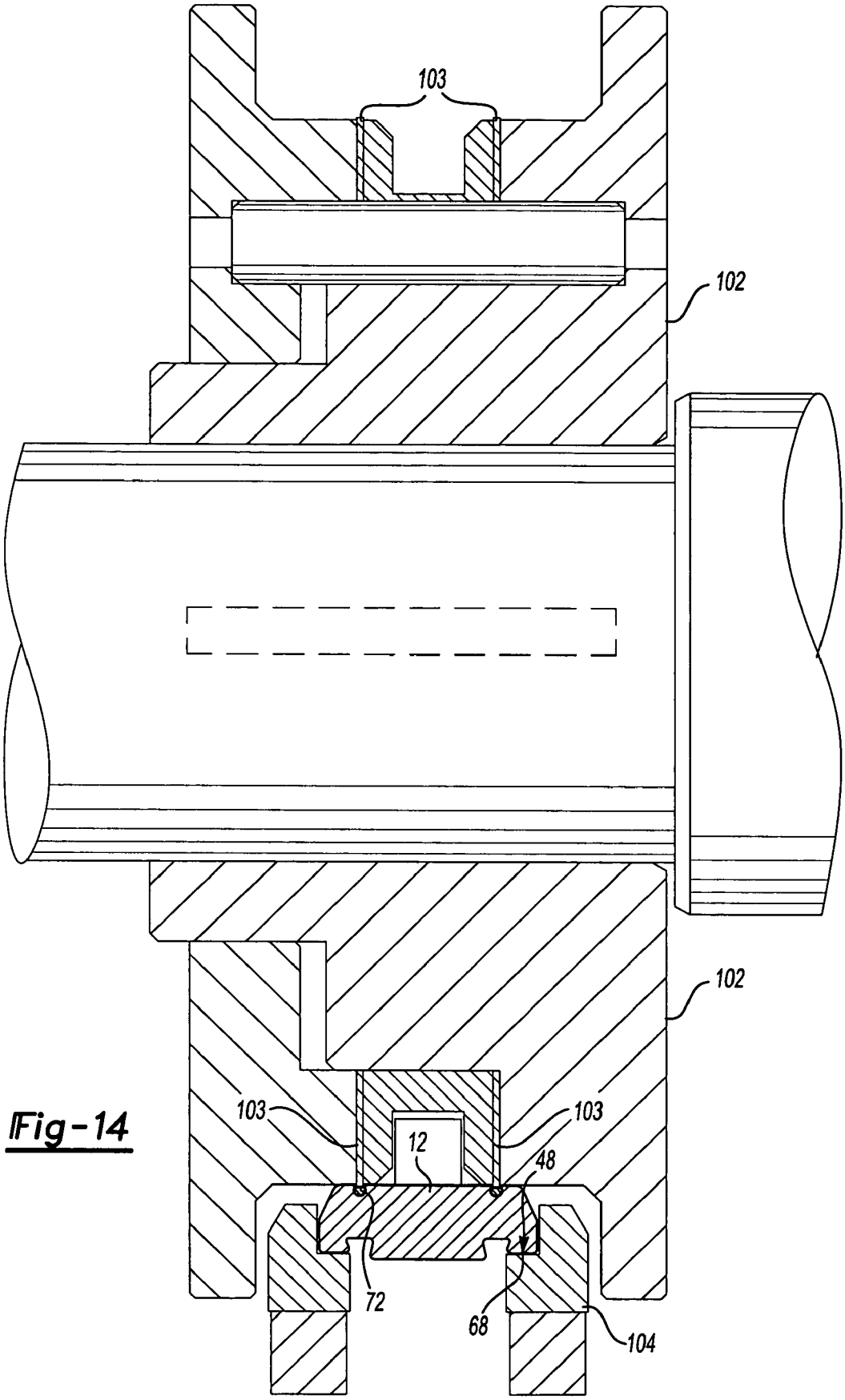
FIG. 14 is a front sectional view of the upper and lower inserter roller.

Referring to FIG. 14, an upper inserter roller 102 is cooperable with a lower inserter roller 104 to guide the carrier wire 72 into the continuous wire groove 18 defined by the pierce nuts 12. Opposing inserter rims 103 are disposed upon the upper inserter roller 102 and are received by the wire groove 18 for forcing the carrier wire 72 into the wire groove 18 as best shown in FIG. 14. The contact pad 48 is also supported by the contact pad support 68 disposed upon the lower regroover roller 104. The upper inserter roller 102 and the lower inserter roller 104 cooperate in the same manner as the regroover rollers 58, 60 of the regroover 56, which is explained in detail above. Accordingly, the associated lever arm 78 and other force producing apparatus will not be redescribed or renumbered for simplicity. It should be understood, however, that less force is required to insert the carrier wire 72 into the wire groove 18 than is required to reform the wire groove 18. It should be further understood that the inserter rollers 102, 104 is synchronized with the regroover rollers 58, 60 to avoid putting tension on the carrier wire 72 or otherwise damaging the fastener strip 16 being produced.

Figure 15:
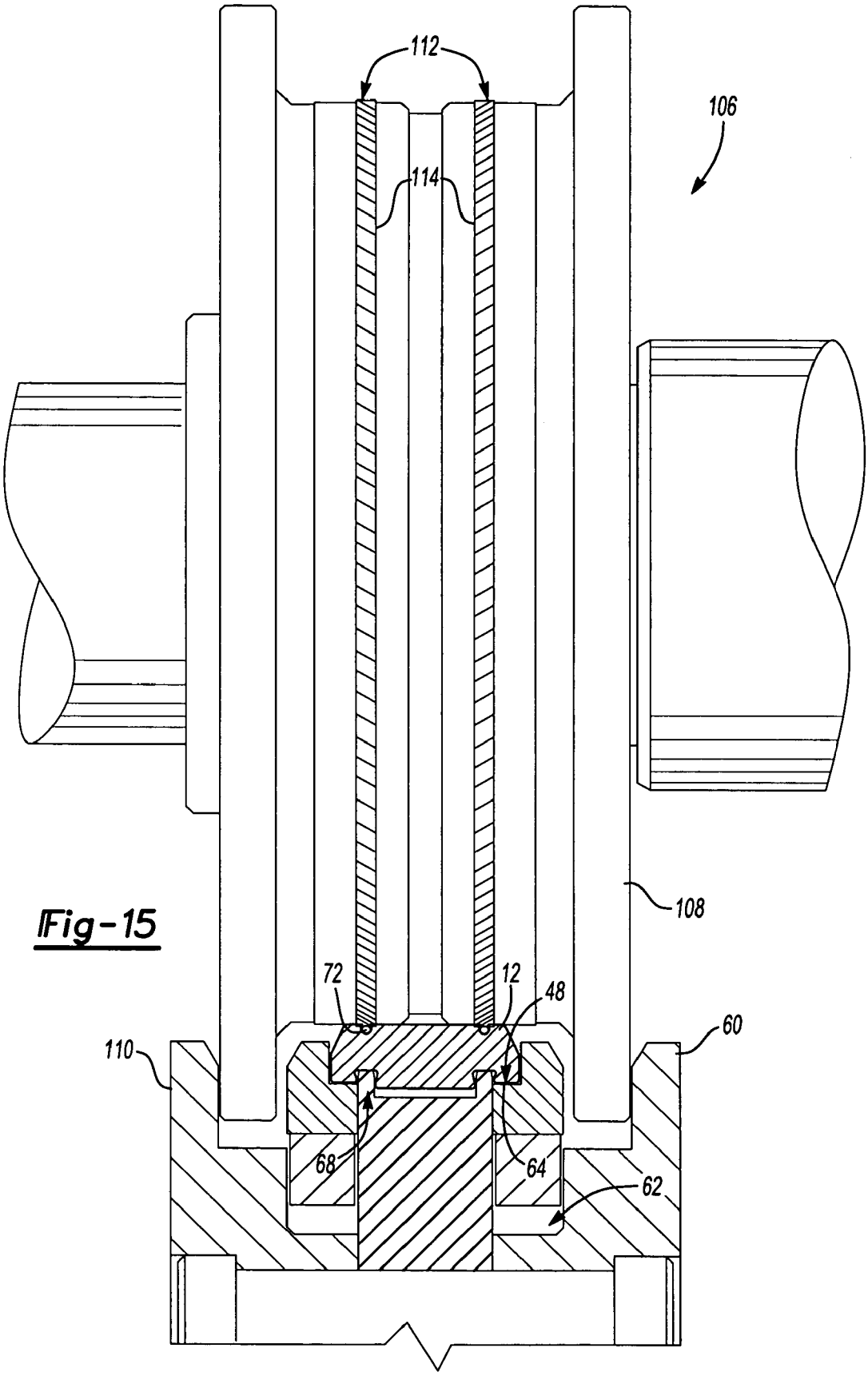
FIG. 15 is a front sectional view of the upper and lower knurler roller.

Referring to FIG. 15, a knurler 106 is located subsequent to the wire inserter 94 for securing the carrier wire 72 to the adjacent pierce nuts 12 forming a continuous fastener strip 16. The knurler 106 includes an upper knurler roller 108 and a lower knurler roller 110. The knurler 106 operates in much the same manner as the regroover 56 and the wire inserter 94 described and set forth in FIGS. 10 and 11. Therefore, for simplicity, the force producer 74 will not be renumbered or described again. However, referring again to FIG. 15, the upper knurler roller 108 is shown having opposing knurling rims 112 defining a continuous loop of chevrons 114. The chevrons 114 deform each pierce nut 12 over the carrier wire 72 securing the carrier wire 72 in the continuous wire groove 18. Alternative patterns to a chevron 114 may also be used to deform the pierce nut 12 over the carrier wire 72.

The lower knurler roller 110 supports the bottom of the pierce nuts 12 in the same manner and in the re-entrant groove 20 as set forth and described with the lower regroover roller 60. Therefore, the various components that support the pierce nut 12 will not be renumbered or explained again for simplicity. It should be understood that the knurler rollers 108, 110 are synchronized with the regroover rollers 58, 60 and the inserter rollers 102, 104 to prevent damaging the fastener strip 16 and the various pierce nuts 12 as previously described.

Figure 16:
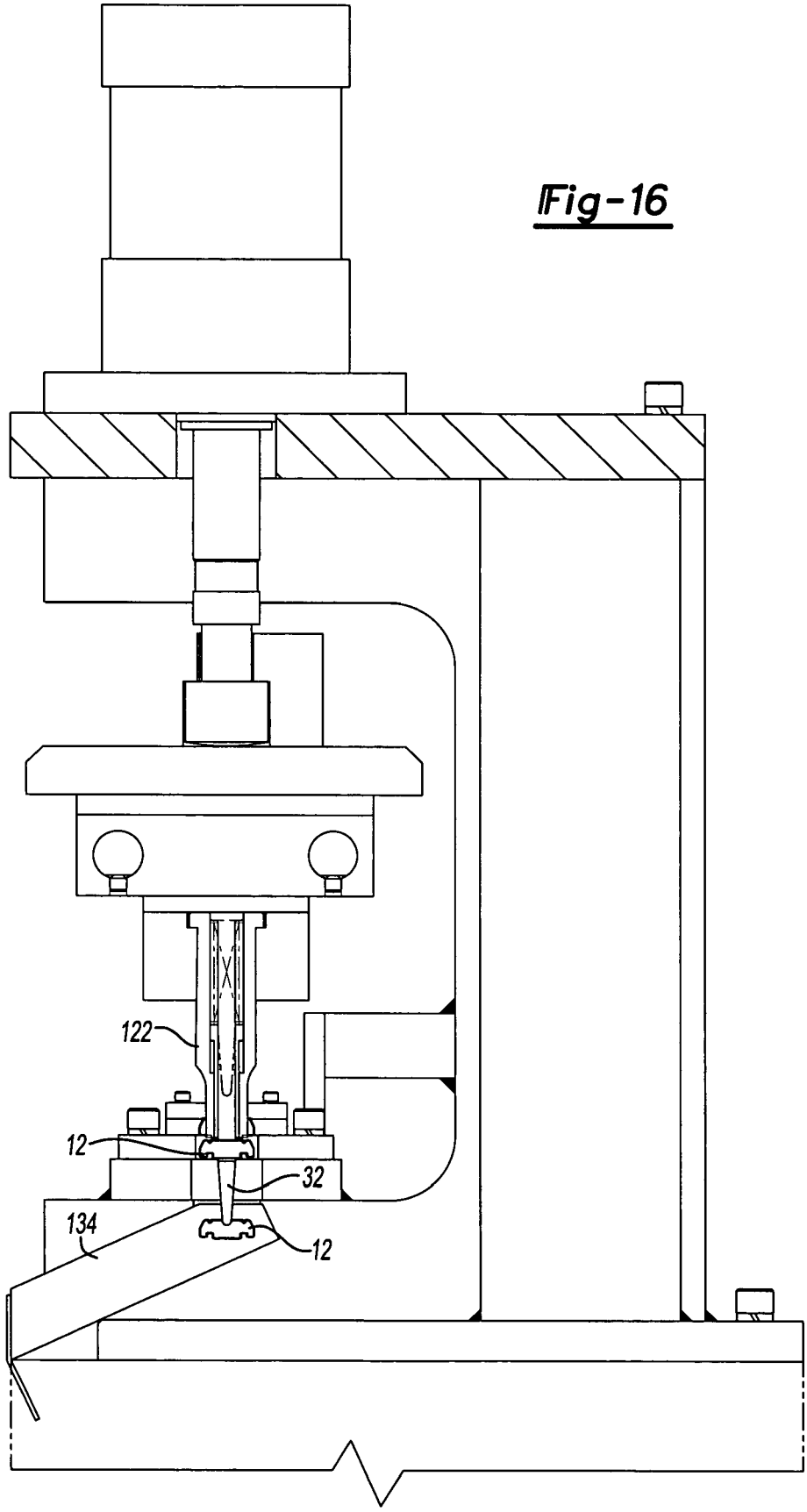
FIG. 16 is a front partial sectional view of the cutter.
Figure 17:
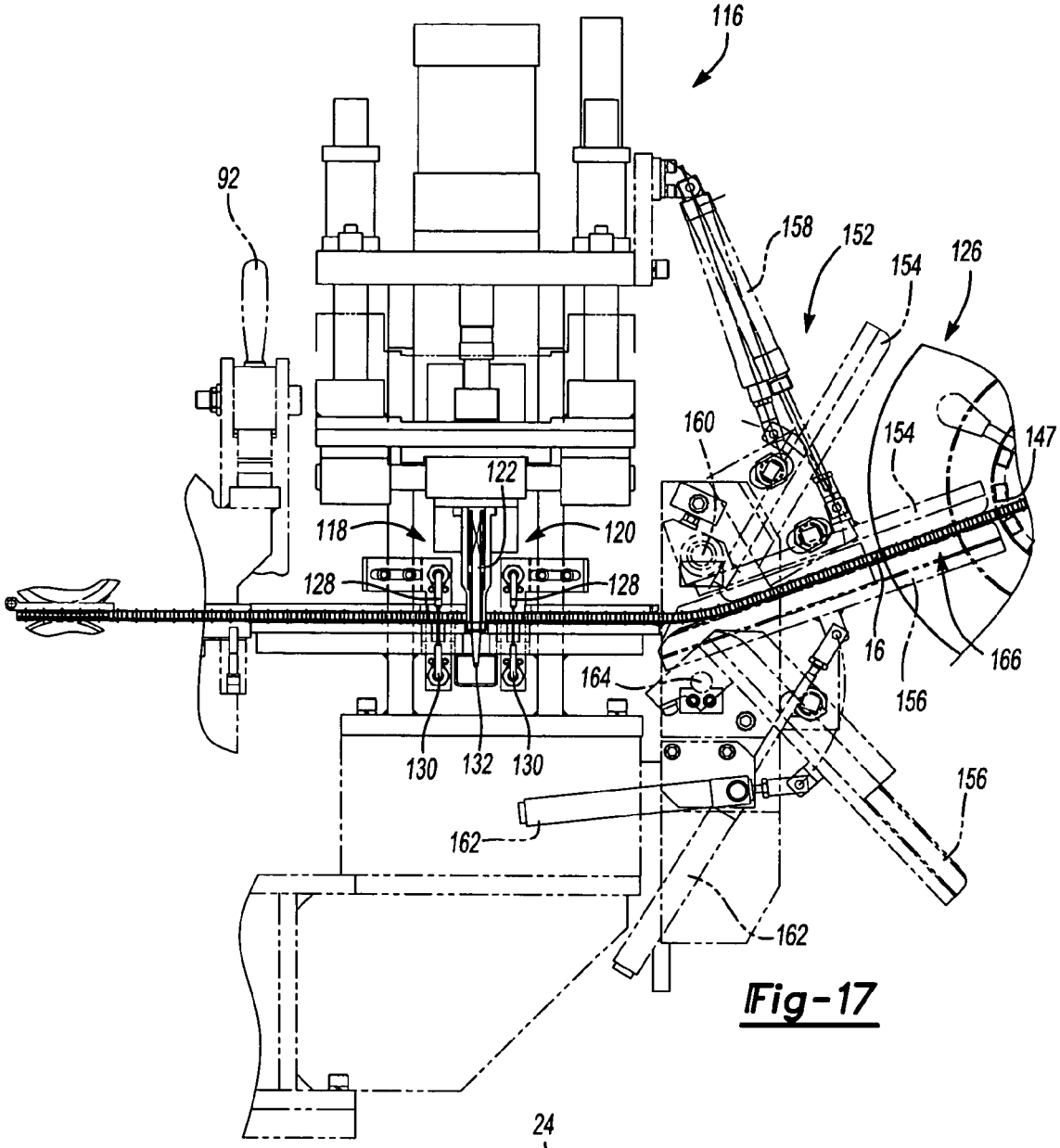
FIG. 17 is a side view of the cutter, counter, and flying bridge of the present invention.
Figure 18:
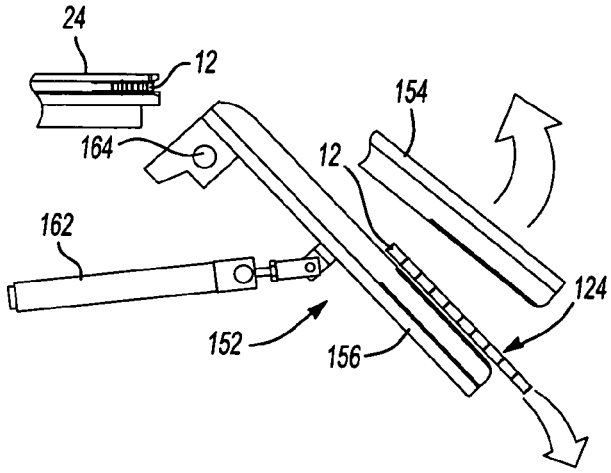
FIG. 18 is a side view of the flying bridge in lowered position for ejecting the test strip.

A counting and cut-off station 116 is located subsequent the knurling station 106. As best seen in FIGS. 2A, 16 and 17, the counting and cut-off station 116 includes a primary counter 118 and a secondary counter 120 to verify the count made by the primary counter 118. A cutter 122 is disposed between the primary counter 118 and the secondary counter 120 and operates like a punch driving in a downward direction to break the carrier wire 72 to both separate the end and beginning of a fastener spool and to separate a test strip 124 (FIG. 18). Therefore, the primary counter counts the number of pierce nuts 12 being directed toward the cutter 122 and the secondary counter 120 counts the number of pierce nuts 12 being delivered to a spooler 126. The primary and secondary counters 118, 120 preferably operate from an infrared sensor, however, other light sources or visioning equipment may be used to count the number of pierce nuts 12 as desired. In the disclosed embodiment, a light emitter 128 transmits light through the aperture 38 disposed in each pierce nut 12 to a light sensor 130 signaling the controller 44 with the primary and secondary count. A locator 132 disposed upon a leading edge of the cutter 122 is received by the aperture 38 defined by the pierce nut 12 being cut from the fastener strip 16 to ensure the cutter 122 does not otherwise damage any of the pierce nuts 12. The cutter 122 drives the fastener 12 downwardly from the continuous track 24 as best shown in FIG. 16 to an escape chute 134 to remove the fastener 12 that has been cut from the process.

Figure 19:
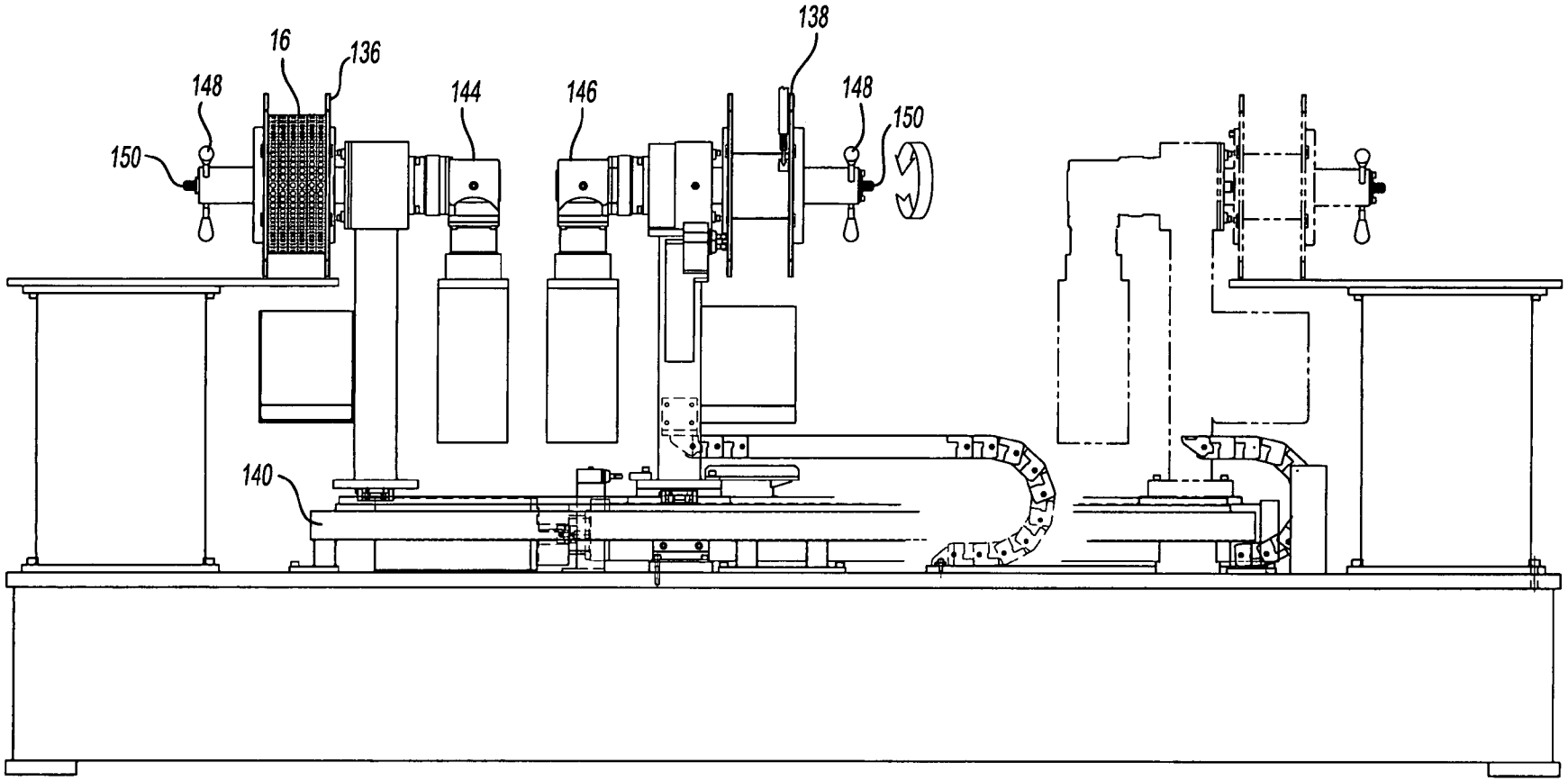
FIG. 19 is a rear view of the first and second spool.
Figure 20:
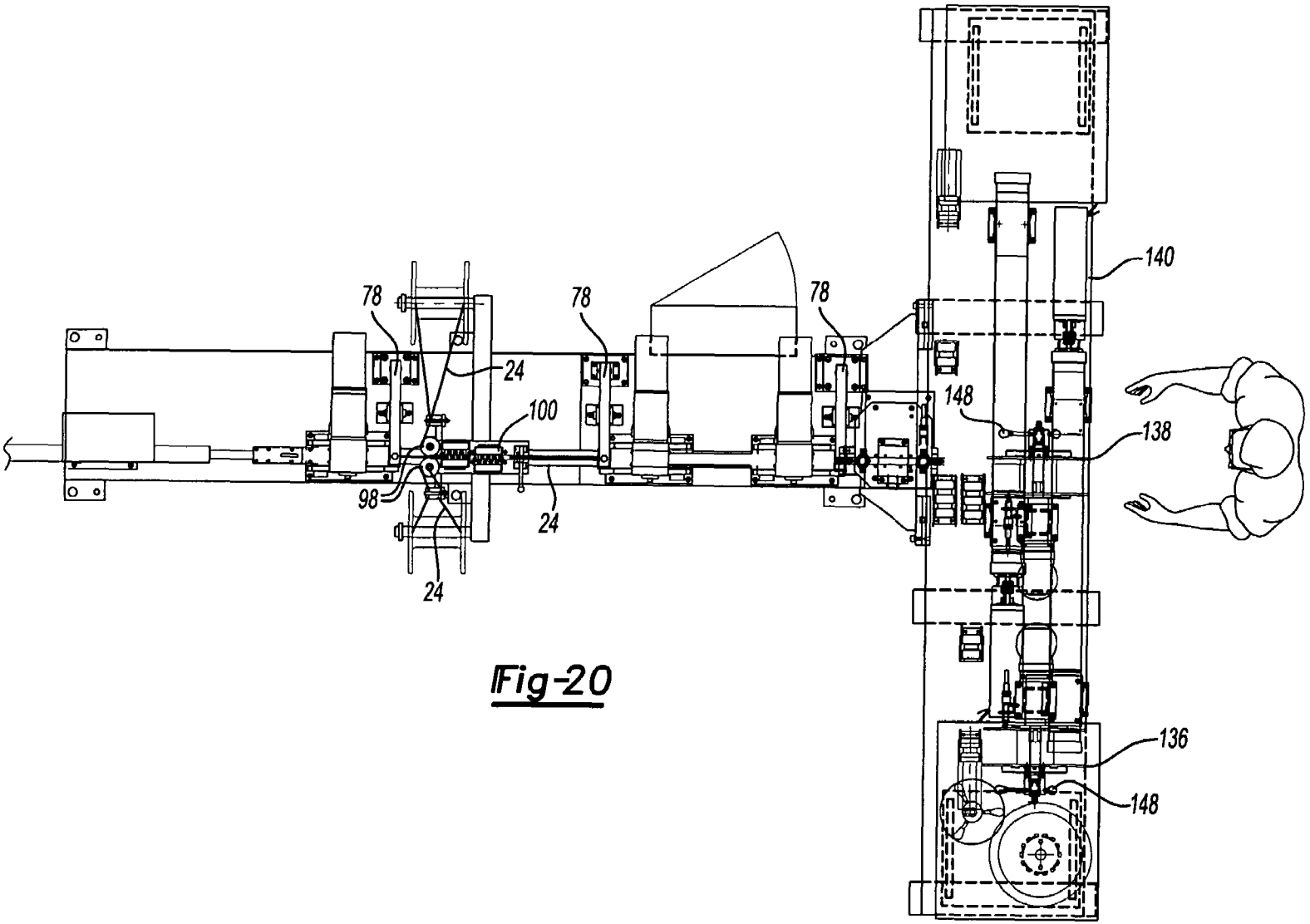
FIG. 20 is a top view of the wire inserter, knurler, cutter, counter, flying bridge, and first and second spool.

The spooler 126 includes a first spool 136 and a second spool 138 as is most clearly seen in FIGS. 19 and 20. The first spool and second spool are located in generally a common axis and articulate so that when one spool 136, 138 is receiving fasteners from the continuous track 24, the other spool may be removed for packaging and shipping. The first spool 136 and the second spool 138 are fixed in a constant relationship upon a sliding surface 140 driven by motor 142 (FIG. 2A) in a direction generally perpendicular to the continuous track 24. As best seen in FIG. 19, the first spool 136 includes a first rotary motor 144 and the second spool 138 includes a second rotary motor 146. As best shown in FIG. 17, each spool 136, 138 includes a catch 147 that receives the continuous fastener strip 16 from the continuous track 24 upon which rotation of the spool 136, 138 by the rotary motor 144, 146 is initiated. Once the desired number of pierce nuts 12 is counted by counters 118, 120, the regroover 56 no longer drives the detached fastener strip 16 as the cutter 122 has separated the fastener strip 16 and the spooling is completed by rotary motors 144, 146. A release 148 affixes each spool 136, 138 to its pivot member 150 and allows rapid removal of the spool 136, 138 once the desired number of pierced nuts 12 have been received.

FIGS. 17 and 18 show a preferred method of directing the fastener strip 16 to the spooler 126 and into the catch 147 of either the first 136 or second 138 spool that makes use of a flying bridge 152. As best shown in FIG. 17, the flying bridge 152 includes an upper bridge member 154 and a lower bridge member 156, each of which actuate to direct the fastener strip 16 in the preferred direction. The upper bridge member 154 is supported by an upper support strut 158 and is actuated pneumatic, hydraulic or equivalent pressure to pivot on a horizontal axis 160 providing a downward directing force to the fastener strip 16. Likewise, the lower bridge member 156 includes a lower support strut 162 and is actuated on a horizontal axis 164 by pneumatic, hydraulic, or equivalent pressure providing an upward directing force to the fastener strip 16. When the upper bridge member 154 and the lower bridge member 156 are fully actuated, a narrow slot 166 is defined therebetween providing a direction of travel for the fastener strip 16 into the catch 147 disposed on one of the first spool 136 or second spool 138. To eject the test strip 124 from the assembly 10, the lower bridge member 156 retracts allowing this test strip 124 to drop into receptor 168 (FIG. 2A).

Figure 3:
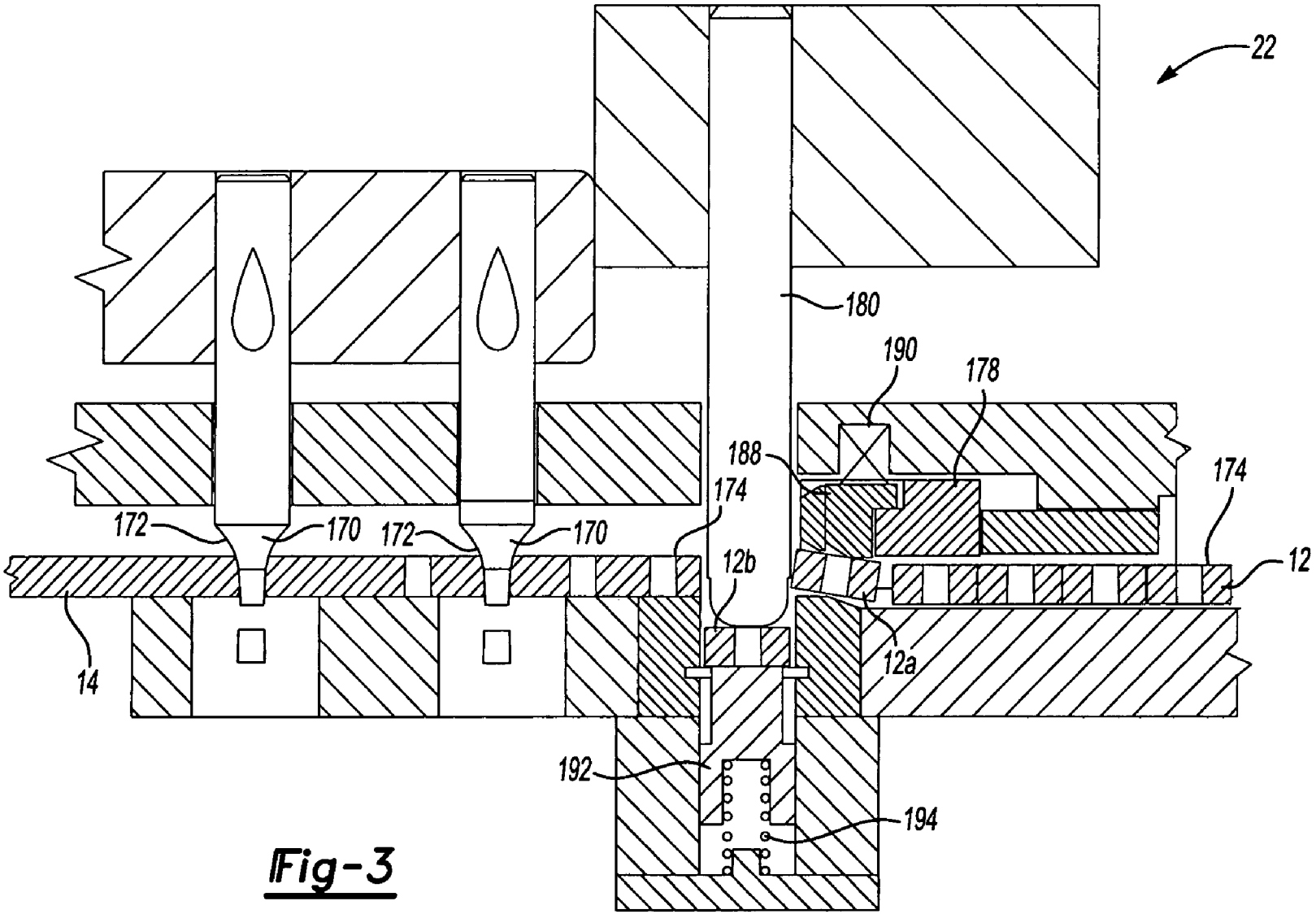
FIG. 3 shows a side sectional view of the inventive die press of the present invention in an actuated position.
Figure 3A:
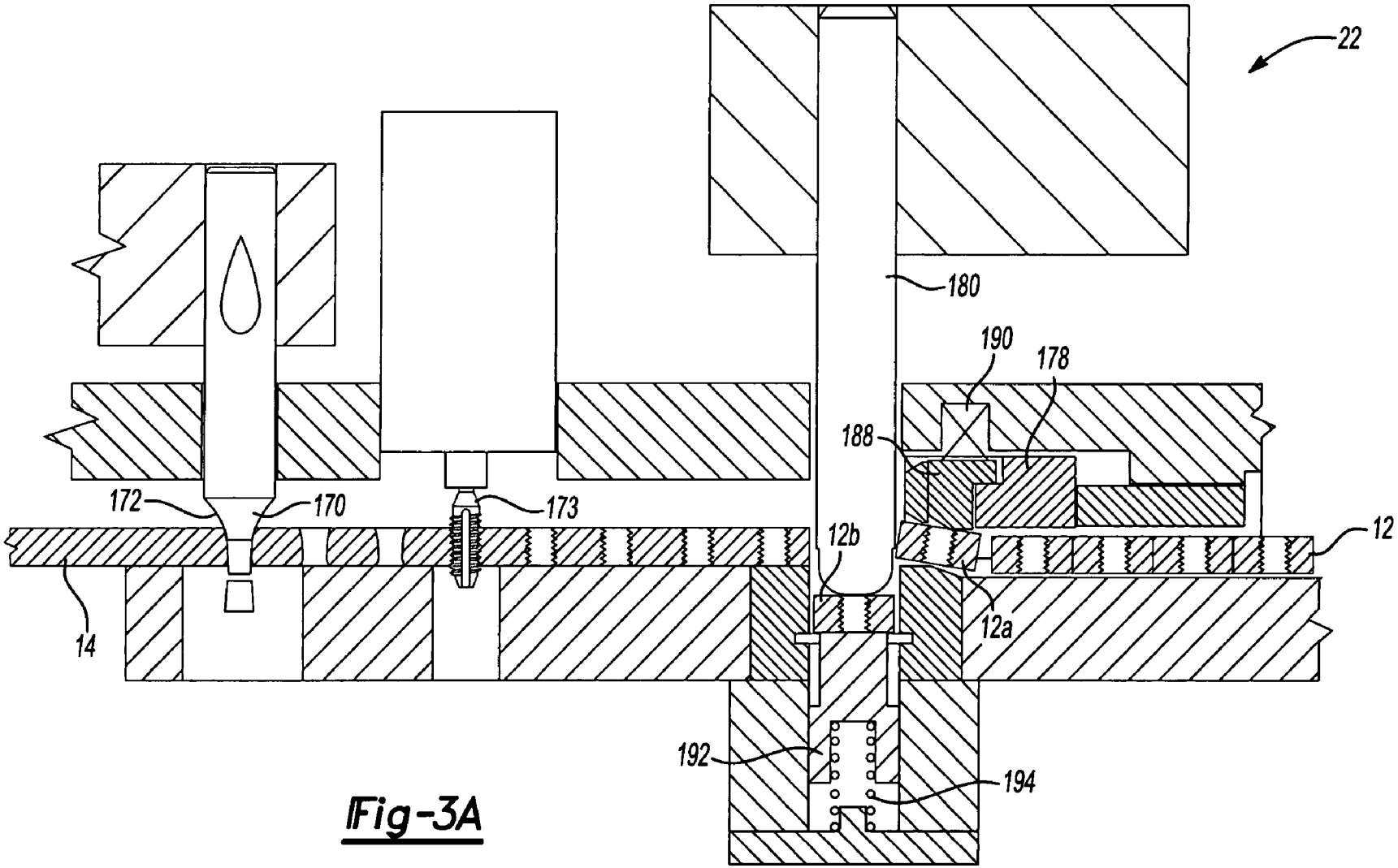
FIG. 3A shows an alternate embodiment of the inventive assembly having a rapid tapper incorporated into the die press.
Figure 4:
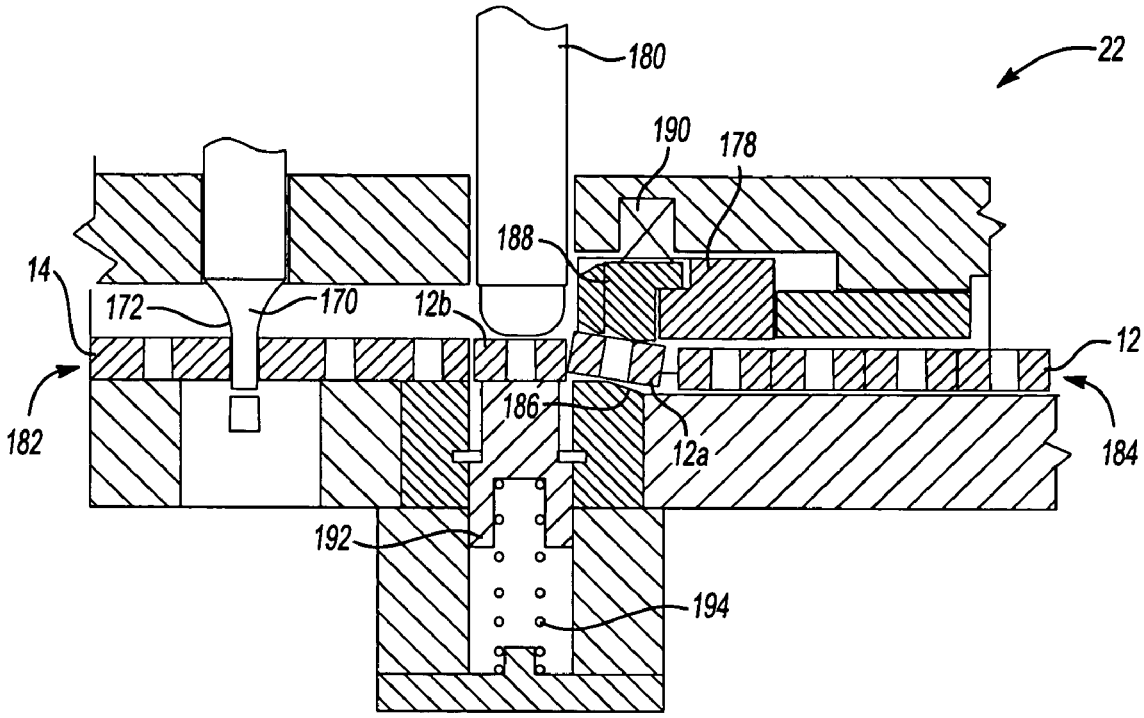
FIG. 4 shows a side sectional view of the inventive die press of the present invention in a partial actuated position.
Figure 5:
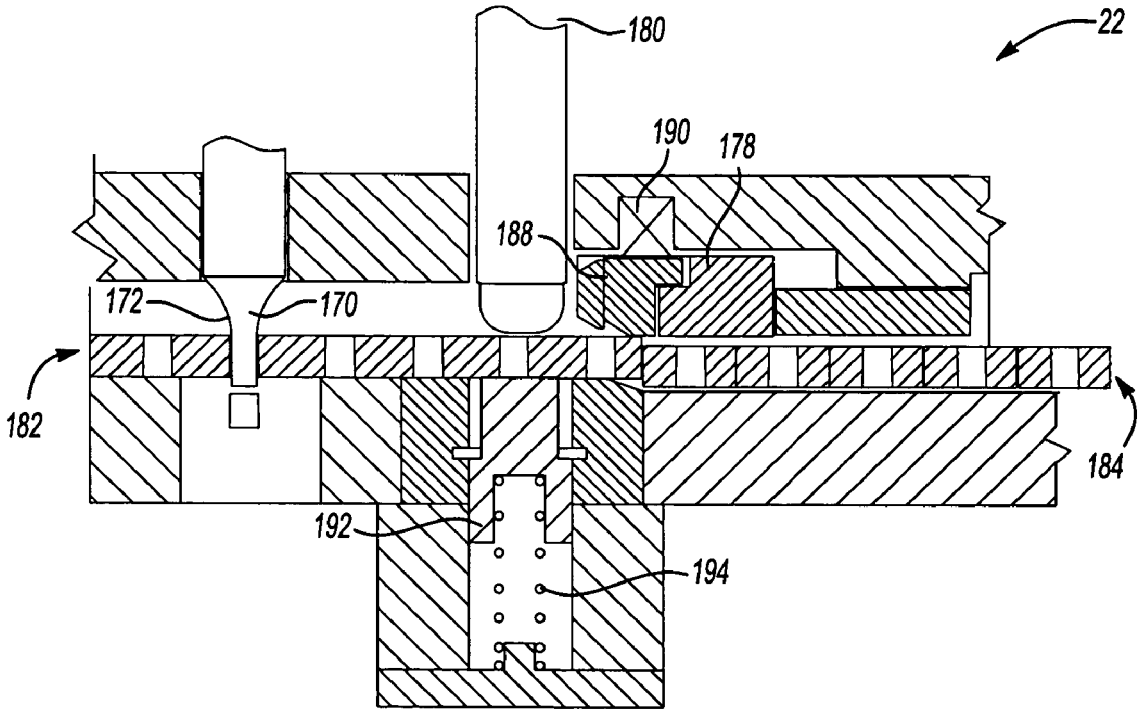
FIG. 5 shows a side sectional view of the inventive die press of the present invention in an open position.

The die press 22 includes novel features enabling rapid production of the pierce nuts 12 and will be further described with respect to FIGS. 3-5. Actuation of the die press in a downward direction causes piercing members 170 to be driven downwardly into the rod 14 received by the die press 22 forming spaced apertures 38 into the rod 14. Each piercing member 170 includes an offset 172 to form a counter sink around the aperture 38. In one preferred embodiment, two piercing members 170 are disposed in each die press 22 so that two apertures 38 are manufactured with each actuation of the die press 22. In an alternative embodiment, shown in FIG. 3A, a rapid tapper 173 is operably connected to the die press 22 so that upon each actuation of the die press, the helical rib 36 is formed on an inner surface of at least one of the apertures 38 formed in the rod 14. In this case, first and second inspectors 28, 30 are positioned immediately subsequent to the die press 22 and the pierce nuts 12 are transferred directly to the wire inserter 94.

When two piercing members 170 are used in the die press 22, the rod 14 is advanced the width of two pierce nuts 12 to abut stop 178. Stop 178 is spaced from a cutting member 180 a distance equal to the width of a single pierce nut 12. In this embodiment, the cutting member 180 separates two pierce nuts 12 from the rod 14 by driving a section of rod 14 downwardly from the continuous track 24 forming a rearward pierce nut 12*a*. The forward pierce nut 12*b* remains in the continuous track 24 in an advanced position. The rod 14 is positioned in a rod plane 82 slightly above the cut fasteners, which are disposed in a fastener plane 184. The forward pierce nut 12*a*, having been separated from the rod 14 is driven downwardly along ramp 186 toward the fastener plane 184 by vertical ejector 188 which derives downward force from spring 190. This drops the leading edge of forward pierce nut 12*a* below stop 178 allowing advancement of the forward pierce nut 12*a* resultant from advancement of the rod 14 toward the stop 178.

As stated previously, rear pierce nut 12*b* is driven downwardly by cutting member 180 separating both the forward pierce nut 12*a* from the pierce nut 12*b* which has been separated from the rod 14. A return member 192 is biased in an upward direction by a spring 194 returning the rear pierce nut 12*b* to the rod plane 182 allowing the forward pierce nut 12*a* and the rearward pierce nut 12*b* to be ejected from the die press in a generally common plane upon advancement of the rod 14 into the die press 22. It should be understood that the return member 192 may be used to eject the rear pierce nut 12B from the die press in a horizontal direction as well as in a vertical direction and in any angle therebetween.

Figure 21:
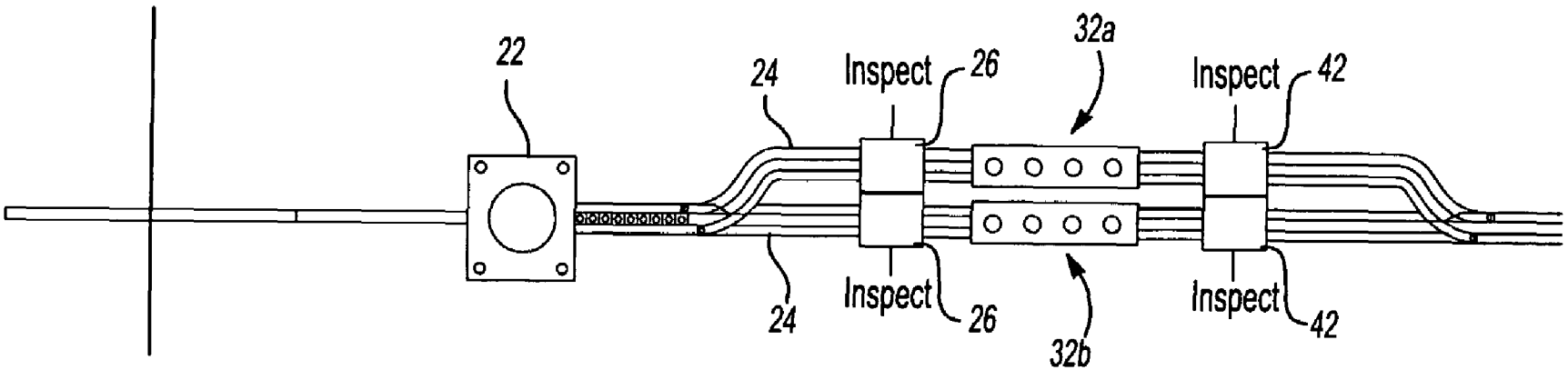
FIG. 21 is an alternative embodiment of the continuous track.
Figure 22:
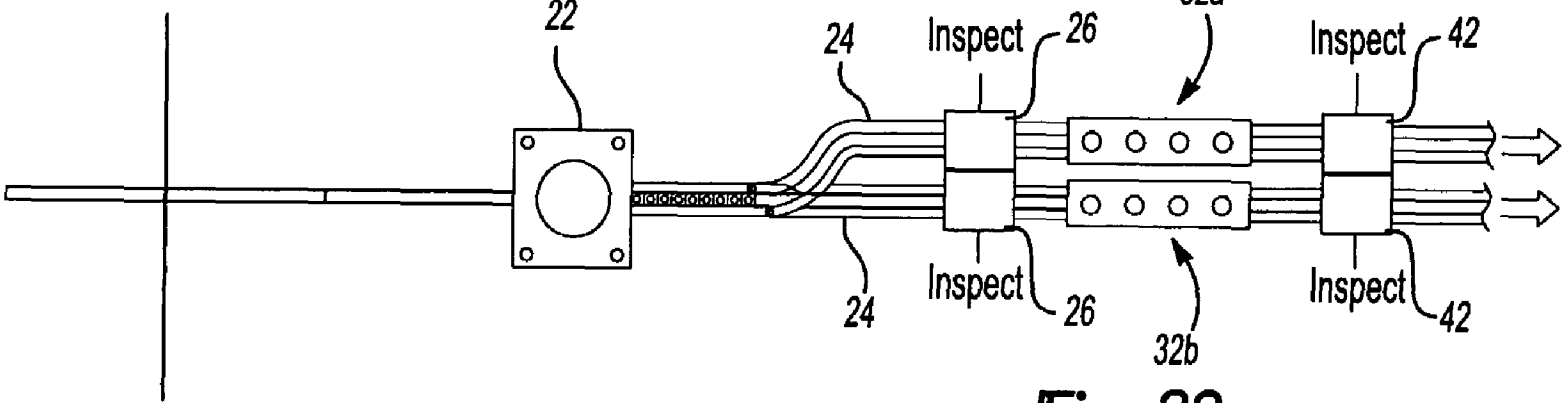
FIG. 22 is a further alternative embodiment of the continuous tract.

It is known to those of skill in the art that various operation stations of any manufacturing process includes bottlenecks that slow down the process unnecessarily when not addressed appropriately. FIGS. 21 and 22 show one method of addressing a bottleneck caused by, for example, the tapping member 32. As set forth above, in one preferred embodiment, the forward pierce nut 12*a* and a rearward pierce nut 12*b* are ejected from the die press 22 in a generally common plane. In so doing, parallel tapping members 32*a* and 32*b* accelerate the process of tapping each pierce nut 12 to twice the single rate. It should be understood, that different size tappers 34 may be used in each of the tapping members 32*a*, 32*b* enabling two different pierce nuts 12 to be manufactured from a single die press 22. It should be further understood that parallel operations are contemplated for any bottleneck determined to slow down the assembly and resultant pierce nut 12 production set forth in the application.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method of continuously manufacturing pierce nuts having a predetermined width from a metal rod with a groove disposed therealong, comprising the steps of:

providing an articulating die having a piercing station for piercing an aperture through said rod and a cutting station for cutting individual pierce nuts from said rod;

advancing the rod through said articulating die and cutting a plurality of pierce nuts, each pierce nut having an aperture pierced therethrough;

said step of cutting individual pierce nuts from said rod being defined by spacing a reciprocable cutting member of said cutting station from a distal end of said rod, a distance equal to generally said predetermined width of said pierce nut;

driving said reciprocable cutting member against said rod, simultaneously cutting two pierce nuts from said rod, including a first pierce nut at said distal end of said rod and a second pierce nut beneath said reciprocable cutting member;

said cutting member driving said second pierce nut from a plane of said rod;

said cutting station resiliently supporting said second pierce nut beneath said reciprocable member, then returning said second pierce nut to said plane of said rod;

then transferring said first and second pierce nuts in sequence in a common plane to a further station; and affixing a wire to said pierce nuts forming a continuous strip of fasteners while maintaining said fasteners in a continuous line.

2. The method as set forth in claim 1, wherein said step of transferring said first and said second pierce nuts from said articulating die is further defined by ejecting said first and said second fastener in an abutting relationship thereby forming a single line of fasteners.

3. The method as set forth in claim 1, wherein said step of transferring said first and said second pierce nuts from said articulating die is further defined by transferring said first and said second pierce nuts in parallel relationship, thereby forming parallel lines of pierce nuts, then performing a further method step on said pierce nuts in said parallel lines.

4. The method as set forth in claim 1, providing a moveable stop spaced from said cutting station a distance equal to said width of said pierce nut.

5. The method set forth in claim 1, wherein said step of maintaining said pierce nuts in a continuous line is further defined by providing a track for maintaining said pierce nuts in a continuous line, said track receiving said first and second pierce nuts from said reciprocable cutting member in a continuous line.

6. The method set forth in claim 1, further including the step of advancing the first and second pierce nuts in a continuous line through said track.

7. The method set forth in claim 1, wherein said step of affixing a wire to said pierce nuts is further defined by advancing the first and the second pierce nuts in a continuous line toward a wire inserter.

8. The method set forth in claim 1, wherein said step of affixing a wire to said pierce nuts is further defined by knurling said wire to said pierce nuts while maintaining said pierce nuts in a common plane thereby forming a continuous strip of pierce nuts.

9. The method set forth in claim 1, further including the step of spooling the continuous strip of pierce nuts.

10. The method set forth in claim 1, further including the step of inspecting the first and the second pierce nuts before connecting the first and the second pierce nuts into a continuous strip of fasteners.

11. The method as set forth in claim 3, wherein said further station is a tapper, wherein said method includes tapping an internal thread in said aperture.

12. A method of making a continuous strip of pierce nuts from a metal rod having a constant width and spaced parallel grooves, comprising the following steps:

providing an articulating die having a piercing station for piercing bores though said rod and a cutting station for cutting individual pierce nuts from said rod;

advancing the rod though said articulating die piercing a plurality of equally spaced bores though said rod;

further advancing said rod though said articulating die to said cutting station, said cutting station including a reciprocating cutting member;

spacing said rod form said reciprocating cutting member a distance equal to a width of said pierce nut between said bores;

driving said reciprocating cutting member against said rod, simultaneously cutting two pierce nuts from said rod, including a first pierce nut at said distal end of said rod and a second pierce nut beneath said reciprocating cutting member;

said reciprocating cutting member driving said second pierce nut from a plane of said rod;

said cutting station resiliently supporting said second pierce nut beneath said reciprocating cutting member, then returning said second pierce nut to said plane of said rod;

then transferring said first and second pierce nuts in a common plane in a track to a tapper;

simultaneously inserting tappers in said bores of said first and second pierce nuts forming an internal thread in said bores; and disposing frangible wires in said parallel grooves and affixing said pierce nuts to said wires in a continuous line through said track.

13. The method set forth in 12, wherein said method includes advancing said first and second pierce nuts upwardly in a track, thereby receiving said frangible wires in said parallel grooves and affixing said wire to said pierce nuts.

14. The method set forth in claim 12, wherein said step of transferring said first and second pierce nuts from said articulating die is further defined by transferring said first and second pierce nuts in parallel relation, thereby forming parallel lines of pierce nuts, then transferring said parallel lines of pierce nuts to said tapper.

* * * * *